US010969176B2

(12) United States Patent
Tian

(10) Patent No.: US 10,969,176 B2
(45) Date of Patent: Apr. 6, 2021

(54) HEAT EXCHANGER

(71) Applicant: DENSO International America, Inc., Southfield, MI (US)

(72) Inventor: Yilin Tian, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 247 days.

(21) Appl. No.: 16/215,168

(22) Filed: Dec. 10, 2018

(65) Prior Publication Data

US 2020/0182548 A1 Jun. 11, 2020

(51) Int. Cl.

| | |
|---|---|
| ***F28D 1/053*** | (2006.01) |
| ***F28F 9/02*** | (2006.01) |
| *F25B 39/00* | (2006.01) |
| *F25B 9/00* | (2006.01) |
| *F28D 1/06* | (2006.01) |

(52) U.S. Cl.

CPC ..... *F28D 1/05391* (2013.01); *F28F 9/0214* (2013.01); *F25B 9/002* (2013.01); *F25B 39/00* (2013.01); *F28D 1/06* (2013.01); *F28F 9/0217* (2013.01); *F28F 2225/08* (2013.01)

(58) Field of Classification Search

CPC ..... F28D 1/06; F28F 9/0214; F28F 9/0217; F28F 2225/04; F28F 2225/08; F25B 9/002; F25B 39/00

USPC ..... 165/173

See application file for complete search history.

(56) References Cited

U.S. PATENT DOCUMENTS

| | | | | |
|---|---|---|---|---|
| 3,583,478 | A * | 6/1971 | Fieni | F28F 1/32 165/178 |
| 4,401,157 | A * | 8/1983 | Cadars | F28D 1/053 165/173 |
| 5,311,934 | A * | 5/1994 | Potier | F28D 1/05316 165/149 |
| 5,535,821 | A * | 7/1996 | Potier | F28D 1/05383 165/173 |
| 7,487,589 | B2 | 2/2009 | Smith et al. | |
| 8,656,988 | B1 | 2/2014 | Paul et al. | |
| 8,707,722 | B2 | 4/2014 | Kim | |
| 2009/0183864 | A1 | 7/2009 | Schnittger et al. | |
| 2013/0206377 | A1 | 8/2013 | Ikoma | |

FOREIGN PATENT DOCUMENTS

| | | | |
|---|---|---|---|
| CN | 101061362 | A | 10/2007 |
| JP | 2000213889 | A | 8/2000 |
| WO | 2018020132 | A1 | 2/2018 |

* cited by examiner

*Primary Examiner* — Joel M Attey
(74) *Attorney, Agent, or Firm* — Brooks Kushman P.C.

(57) ABSTRACT

A heat exchanger includes a header, a plurality of tubes, and a reinforcement member. The header has a face plate that defines a plurality of orifices, a top plate that extends away from an end of the face plate, and a projection that extends outward from the top plate. Each of the plurality of tubes extend into a respective one of the plurality of orifices. The reinforcement member has a backing plate that is secured to the top plate, a brace that extends from the backing plate and is secured to a first of the plurality of tubes, and a protrusion that extends outward from the backing plate. The protrusion engages the projection to restrict movement of the reinforcement member in a longitudinal direction relative to the tubes.

11 Claims, 9 Drawing Sheets

HEAT EXCHANGER

TECHNICAL FIELD

The present disclosure relates to heat exchangers, particularly to tube and fin type heat exchangers.

BACKGROUND

Tube and fin heat exchangers may be utilized to transfer heat between a fluid flowing through the tubes of the heat exchanger and air that is being direct across the fins of the heat exchanger.

SUMMARY

A heat exchanger includes a header, a plurality of tubes, and a reinforcement member. The header has a face plate that defines a plurality of orifices, a top plate that extends away from an end of the face plate, and a projection that extends outward from the top plate. Each of the plurality of tubes extend into a respective one of the plurality of orifices. The reinforcement member has a backing plate that is secured to the top plate, a brace that extends from the backing plate and is secured to a first of the plurality of tubes, and a protrusion that extends outward from the backing plate. The protrusion engages the projection to restrict movement of the reinforcement member in a longitudinal direction relative to the tubes.

A heat exchanger includes a header plate, a first tube, a second tube, a first member, and a reinforcement member. The header plate defines a plurality of orifices. The first and second tubes are configured to channel coolant through the heat exchanger. Each of the first and second tubes extend into a respective one of the plurality of orifices. The first member is disposed between the first and second tubes, extends into one of the plurality of orifices, and defines a notch adjacent to the header plate. The reinforcement member has a backing plate and a tab that extends downward from the backing plate and into the notch.

A heat exchanger includes a header plate, a plurality of tubes, a first reinforcement member, and a second reinforcement member. The header plate defines a plurality of orifices. Each of the plurality of tubes extends into a respective one of the plurality of orifices. Each of the first and second reinforcement members has a backing plate and a U-shaped bracket extending from the backing plate. Open ends of the U-shaped brackets of the first and second reinforcement members extend toward each other from the opposing sides of the tubes, straddle at least one of the plurality of tubes, and interlock with each other to secure the first reinforcement member to the second reinforcement member.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
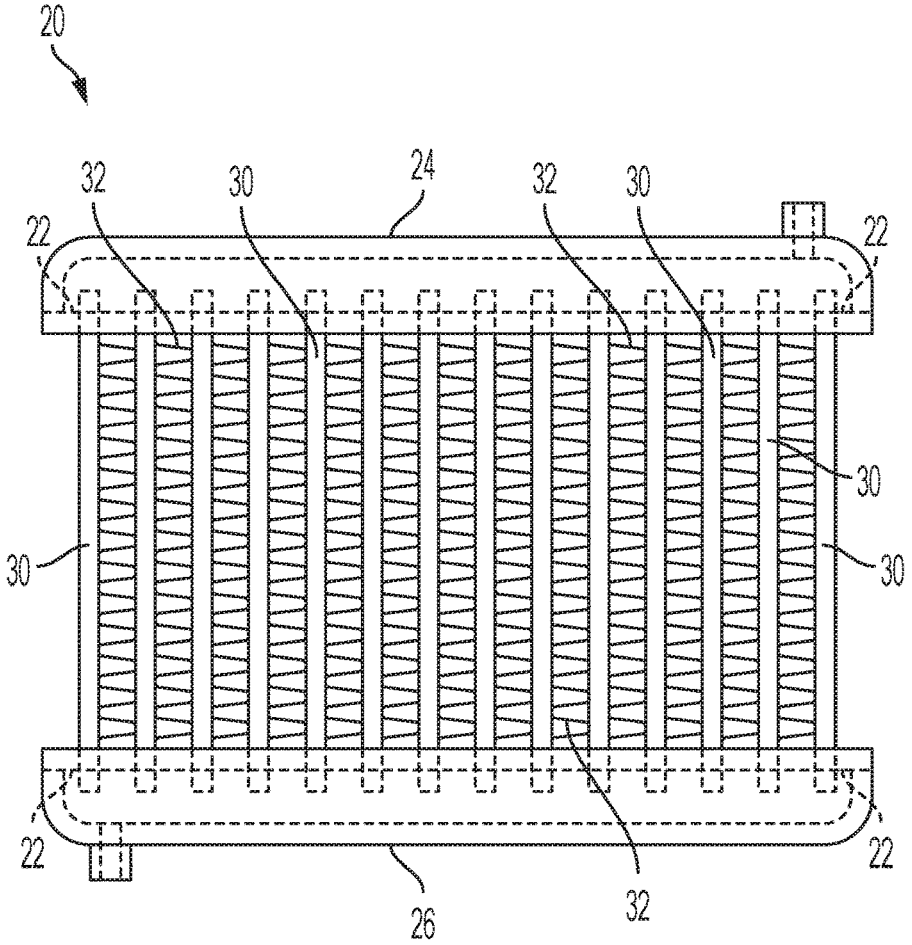
FIG. 1 is a front view of a heat exchanger.
Figure 2:
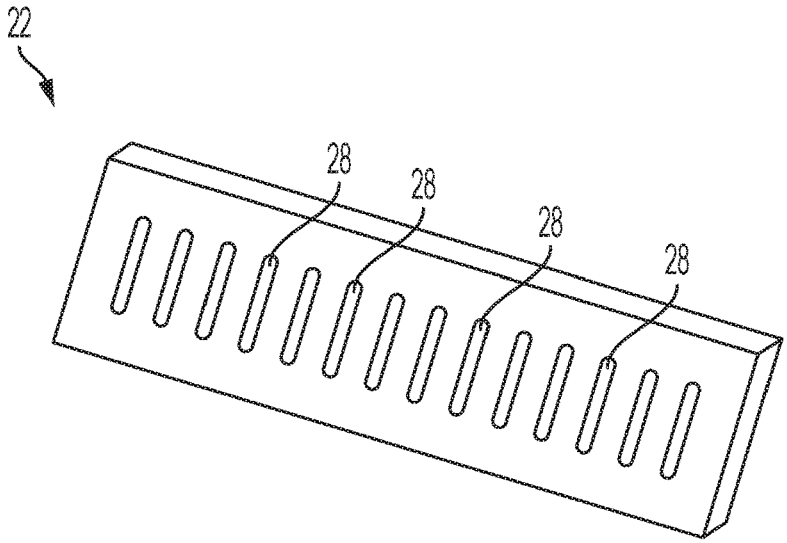
FIG. 2 is a perspective view of a header plate.

Referring to FIGS. 1 and 2, a heat exchanger 20 and a header 22 of the heat exchanger 20 are illustrated, respectively. The header 22 may also be referred to as a header plate. The heat exchanger 20 includes a first header tank 24 and a second header tank 26. A first header 22 is secured to the first header tank 24 and a second header 22 is secured to the second header tank 26. Each header 22 defines a plurality of orifices 28. A plurality of tubes 30 extend between the first header tank 24 and the second header tank 26. More specifically, a first end of each of the tubes 30 extends into a respective one of the plurality of orifices 28 of the first header 22 while a second end of each of the tubes 30 extends into a respective one of the plurality of orifices 28 of the second header 22. Each of the plurality of tubes 30 may be secured to the headers 22 by brazing each tube 30 to the headers 22 proximate the respective orifices 28 that the first and second ends of the tubes 30 extend into. The plurality of tubes 30 are configured to channel a coolant, a refrigerant, or any other heat exchanging liquid or gas from the first header tank 26 to the second header tank 28. Coils or fins 32 are disposed between adjacent tubes 30. The fins 30 facilitate heat transfer between the liquid or gas that is flowing through the plurality of tubes 30 and air that is being directed across the heat exchanger 20.

The heat exchanger 20 and header 22 depicted in FIGS. 1 and 2 are not meant to be limiting. For example, the first header tank 26 and the second header tank 28 are shown to include a single chamber for storing the heat transferring liquid or gas. However, other embodiments that include divider walls within the first header tank 26 and the second header tank 28 that divide the single chamber of the respective tanks into multiple chambers should be construed as disclosed herein. As another example, the header 22 is depicted to define a single row of orifices 28. However, other embodiments where the header 22 defines multiple rows and/or columns of orifices 28 should be construed as disclosed herein. The heat exchanger 20 may be utilized in any system that requires a transfer of heat from a first fluid to a second fluid. For example, the exchanger 20 may be utilized as a radiator or a heater core in an engine cooling system of an automobile. As another example, the heat exchanger may be utilized as an evaporator or as a condenser in an air conditioning system.

Figure 3:
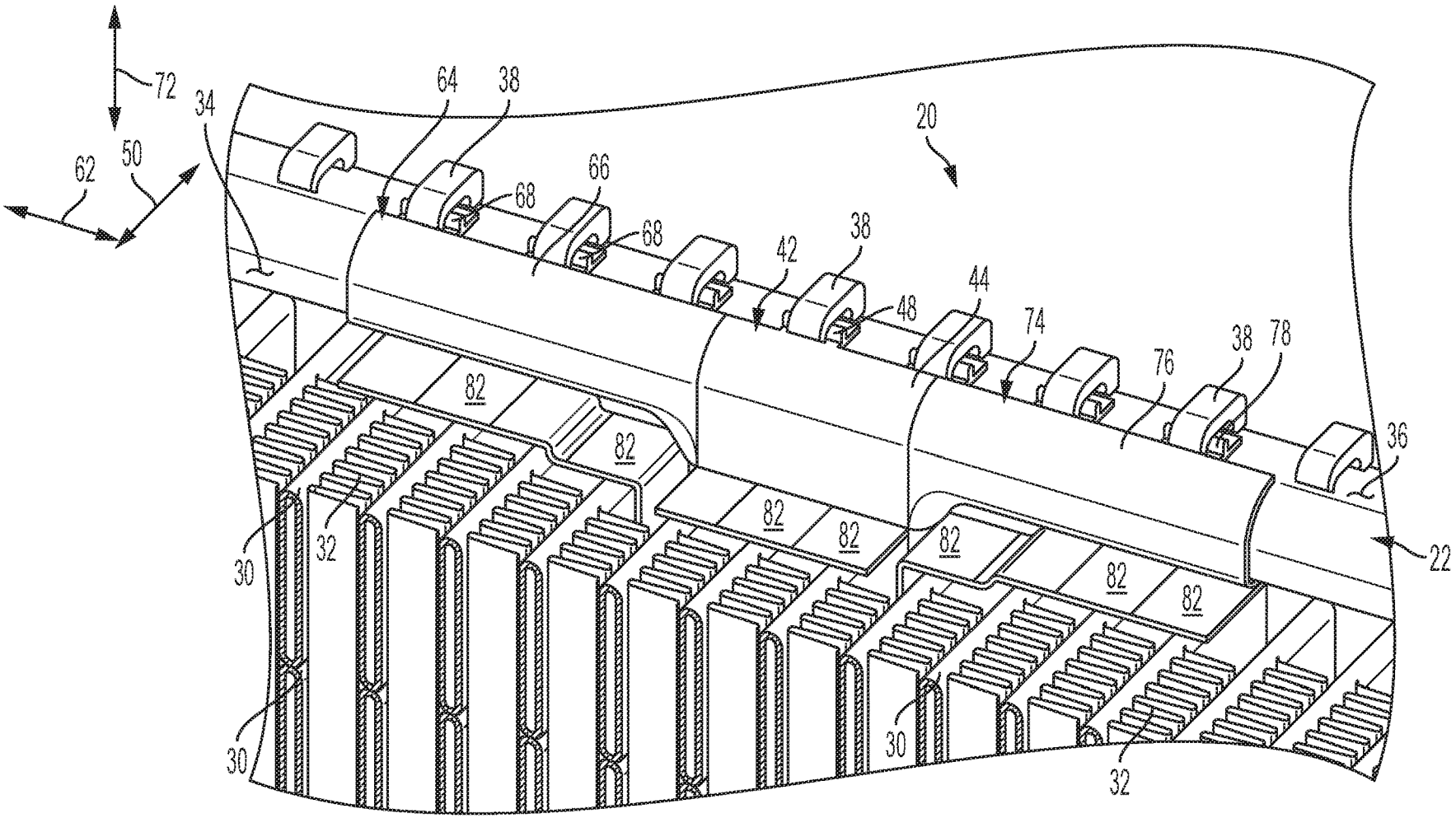
FIG. 3 is a perspective view of a portion of the heat exchanger including first type of reinforcement members prior to securing the first type of reinforcement members to the heat exchanger.
Figure 4:
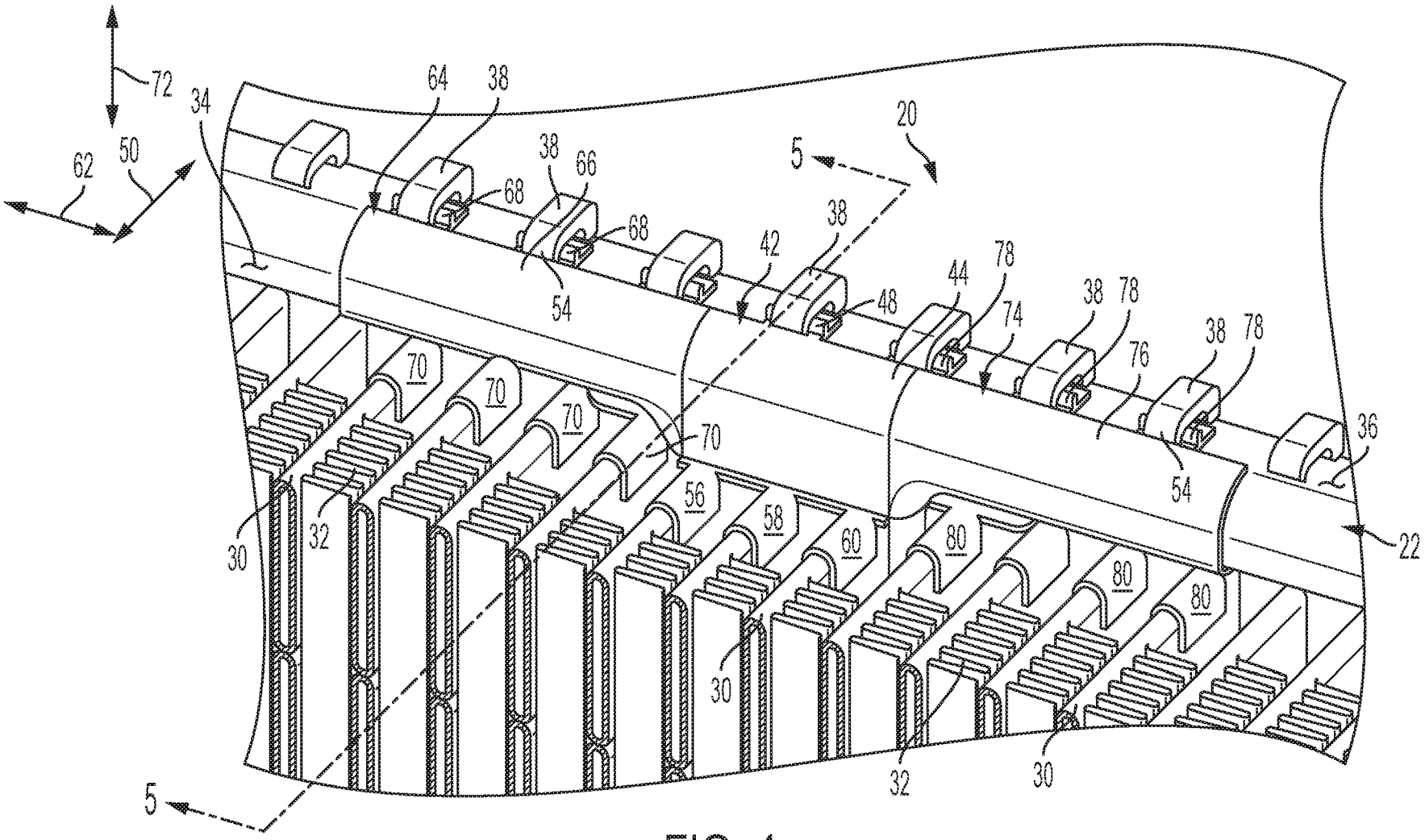
FIG. 4 is a perspective view of the portion of the heat exchanger including the first type of reinforcement members after the first type of reinforcement members have been secured to the heat exchanger.
Figure 5:
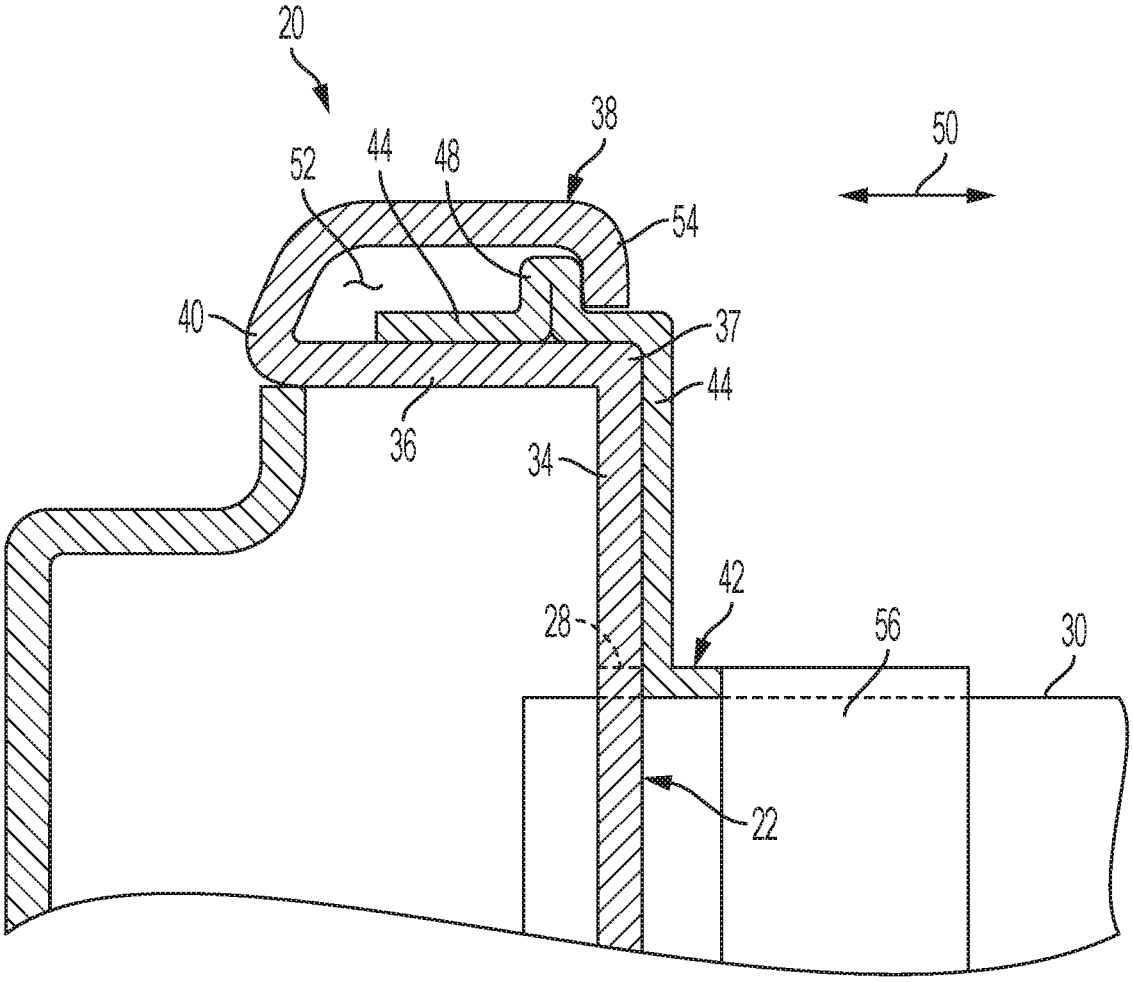
FIG. 5 is a cross-sectional view taken along line 5-5 in FIG. 4.

Referring to FIGS. 3-5, a portion of the heat exchanger 20 including first type of reinforcement members is illustrated. FIG. 3 depicts the reinforcement members prior to the reinforcement members being secured to the heat exchanger 20, FIG. 4 depicts the reinforcement members after the reinforcement members have been secured to the heat exchanger 20, and FIG. 5 depicts a cross-sectional view taken along line 5-5 in FIG. 4.

The configuration of the plurality of tubes 30 of the heat exchanger 20 in FIGS. 3-5 includes two rows of tubes 30 that are arranged in columns comprising two tubes 30. The configuration of the tubes 30 is not meant to be limiting. The header 22 has a face plate 34 that defines the plurality of orifices 28. The header 22 also includes a top plate 36 that extends away from an end 37 of the face plate 34 and one or more projections 38 that extend outward from the top plate 36. More specifically, the projections 38 may be hooks that extend outward from the top plate 36, overhang the top plate 36, and extend back towards the face plate 34 from a backend 40 of the top plate 36.

A first reinforcement member 42 is secured to the header 22. More specifically, the first reinforcement member 42 has a first backing plate 44 that secured to the top plate 36 of the header 22. The first backing plate 44 may be bent or curved so that it is also secured to the face plate 34 of the header 22 in addition to the top plate 36. The first backing plate 44 of the first reinforcement member 42 may be secured to the header 22 via brazing, welding, or any other attachment method. One or more protrusions 48 extend outward from the first backing plate 44, each engaging one of the projections 38 to restrict movement of the first reinforcement member 42 in a longitudinal direction 50 relative to the plurality of tubes 30 (i.e., the direction in which the plurality of tubes 30 extend). More specifically, a space 52 may be defined between each of the projections 38 (i.e., hooks) and the top plate 36, and each of the protrusions 48 may be disposed within the space 52 defined between one of the projections 38 and the top plate 36. A hooked end 54 of the each of the projections 38 may engage one of the protrusions 48 in order to retain the protrusion 48 within the space 52 and to restrict movement of the reinforcement member 42 in the longitudinal direction 50 relative to the plurality of tubes 30.

A first brace 56 extends from the first backing plate 44 and is secured to a first of the plurality of tubes 30. More specifically, the first brace 56 may be U-shaped and may straddle a first of the plurality of tubes 30. A second brace 58 and a third brace 60 each may also extend from the first backing plate 44. The second brace 58 and the third brace 60 may be secured to a second and a third of the plurality of tubes 30, respectively. The second brace 58 and the third brace 60 may also be U-shaped and may straddle the second and the third of the plurality of tubes 30, respectively. The first brace 56, second brace 58, and third brace 60 may be aligned in a transverse direction 62 relative to the plurality of tubes 30 (e.g., a direction that is perpendicular to the longitudinal direction 50). The first brace 56, second brace 58, and third brace 60 may be secured to a respective one of the plurality of tubes 30 via brazing, welding, or any other attachment method.

A second reinforcement member 64 may be secured to the header 22. More specifically, the second reinforcement member 64 has a second backing plate 66 that secured to the top plate 36 of the header 22. The second backing plate 66 may be bent or curved so that it is also secured to the face plate 34 of the header 22 in addition to the top plate 36. The second backing plate 66 of the second reinforcement member 64 may be secured to the header 22 via brazing, welding, or any other attachment method. One or more protrusions 68 extend outward from the second backing plate 66, each engaging one of the projections 38 to restrict movement of the second reinforcement member 64 in the longitudinal direction 50 relative to the plurality of tubes 30. More specifically, each of the protrusions 68 may be disposed within the space 52 defined between one of the projections 38 and the top plate 36. A hooked end 54 of the each of the projections 38 may engage one of the protrusions 68 in order to retain the protrusion 68 within the space 52 and to restrict movement of the second reinforcement member 64 in the longitudinal direction 50 relative to the plurality of tubes 30.

One or more braces 70 extend from the second backing plate 66 and are each secured to a respective one of the plurality of tubes 30. More specifically, the braces 70 may be U-shaped and may straddle a respective one of the plurality of tubes 30. The one or more braces 70 may be aligned in the transverse direction 62 relative to the plurality of tubes 30 (e.g., a direction that is perpendicular to the longitudinal direction 50). One or more of the plurality of tubes 30 may be offset from the remainder of the plurality of tubes in a direction 72 that is perpendicular to a plane that includes the longitudinal direction 50 and the transverse direction 62. The braces 70 that are secured to the offset tubes 30 will also be offset from the remainder of the one or more braces 70 in the direction 72 that is perpendicular to the plane that includes the longitudinal direction 50 and the transverse direction 62. The one or more braces 70 may be secured to a respective one of the plurality of tubes 30 via brazing, welding, or any other attachment method.

A third reinforcement member 74 may be secured to the header 22. More specifically, the third reinforcement member 74 has a third backing plate 76 that secured to the top plate 36 of the header 22. The third backing plate 76 may be bent or curved so that it is also secured to the face plate 34 of the header 22 in addition to the top plate 36. The third backing plate 76 of the third reinforcement member 74 may be secured to the header 22 via brazing, welding, or any other attachment method. One or more protrusions 78 extend outward from the third backing plate 76, each engaging one of the projections 38 to restrict movement of the third reinforcement member 74 in the longitudinal direction 50 relative to the plurality of tubes 30. More specifically, each of the protrusions 78 may be disposed within the space 52 defined between one of the projections 38 and the top plate 36. A hooked end 54 of the each of the projections 38 may engage one of the protrusions 78 in order to retain the protrusion 78 within the space 52 and to restrict movement of the third reinforcement member 74 in the longitudinal direction 50 relative to the plurality of tubes 30.

One or more braces 80 extend from the third backing plate 76 and are each secured to a respective one of the plurality of tubes 30. More specifically, the braces 80 may be U-shaped and may straddle a respective one of the plurality of tubes 30. The one or more braces 80 may be aligned in the transverse direction 62 relative to the plurality of tubes 30 (e.g., a direction that is perpendicular to the longitudinal direction 50). One or more of the plurality of tubes 30 may be offset from the remainder of the plurality of tubes in the direction 72 that is perpendicular to the plane that includes the longitudinal direction 50 and the transverse direction 62. The braces 80 that are secured to the offset tubes 30 will also be offset from the remainder of the one or more braces 80 in the direction 72 that is perpendicular to the plane that includes the longitudinal direction 50 and the transverse direction 62. The one or more braces 80 may be secured to a respective one of the plurality of tubes 30 via brazing, welding, or any other attachment method.

Figure 6:
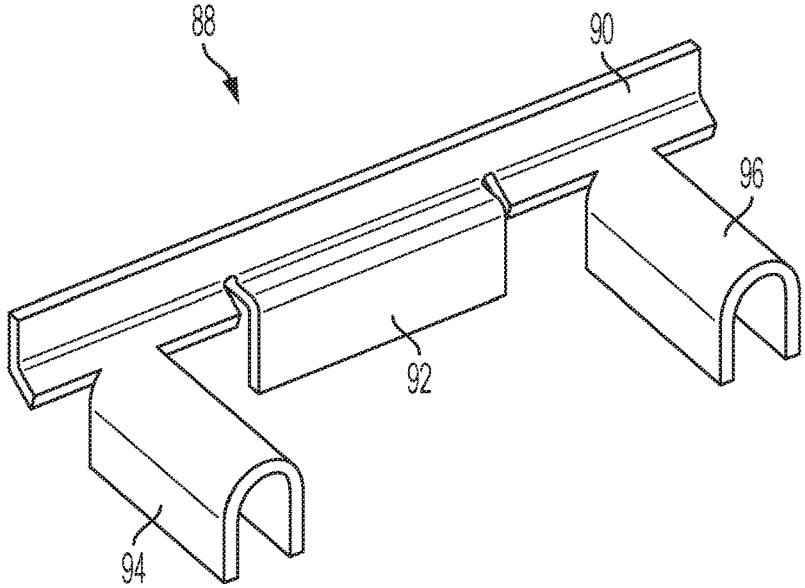
FIG. 6 is a perspective view of a second type of reinforcement member.

The first reinforcement member 42, second reinforcement member 64, and third reinforcement member 74 may be installed by aligning the protrusion 48, 68, 78 with the gaps between adjacent projections 38 that extend from the header 22. Next, the first reinforcement member 42, second reinforcement member 64, and third reinforcement member 74 are then adjusted in the longitudinal direction 50 until the backing plates 44, 66, 76 are forced into contact with the face plate 34 and the top plate 36 of the header 22. Once the backing plates 44, 66, 76 are forced into contact with the face plate 34 and the top plate 36 of the header 22 the first reinforcement member 42, second reinforcement member 64, and third reinforcement member 74 are adjusted in the transverse direction 62 until each of the protrusions 48, 68, 78 is positioned in one of the spaces 52 defined between one of the projections 38 and the top plate 36. Up until this point in the installing process, the braces 56, 58, 60, 70, 80 may be in the form of flat plates or tabs 82 as depicted in FIG. 3. The flat plates for tabs 82 are then bent downward to form the U-shaped braces 56, 58, 60, 70, 80. Once the braces 56, 58, 60, 70, 80 have been formed, the backing plates 44, 66, 76 may be secured to the header 22 via brazing, welding, or any other attachment method and each of the braces 56, 58, 60, 70, 80 may be secured to a respective one of the plurality of tubes 30 via brazing, welding, or any other attachment method Referring to FIGS. 6, 7, and 8, a perspective view of a second type of reinforcement member, a perspective view of a portion of the heat exchanger 20 including a "dummy" tube, and a perspective view of a portion of the heat exchanger 20 including the second type of reinforcement member after the second type of reinforcement member has been secured to the heat exchanger 20 are illustrated, respectively. The heat exchanger 20 depicted in FIGS. 7 and 8 includes all the same components as the heat exchanger depicted in FIGS. 3-5 unless otherwise state herein. For example, the heat exchanger depicted in FIGS. 7 and 8 does not include the projections 38 that overhang the top plate 36 of the header 22 and the reinforcement member is different than the reinforcement members 42, 64, 74 depicted in FIGS. 3-5.

Figure 7:
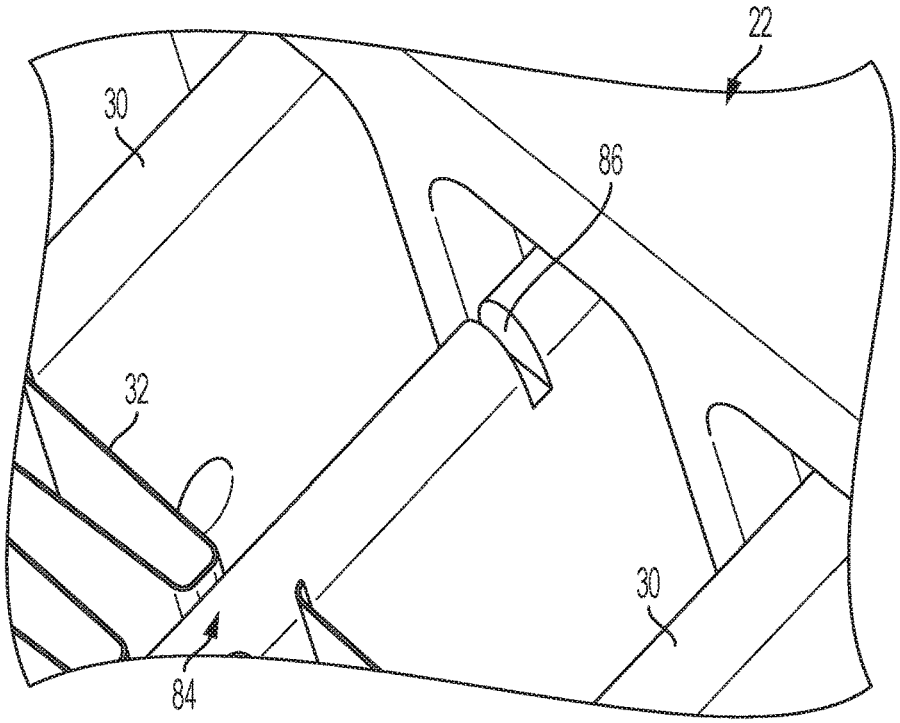
FIG. 7 is a perspective view of a portion of the heat exchanger including a "dummy" tube.
Figure 8:
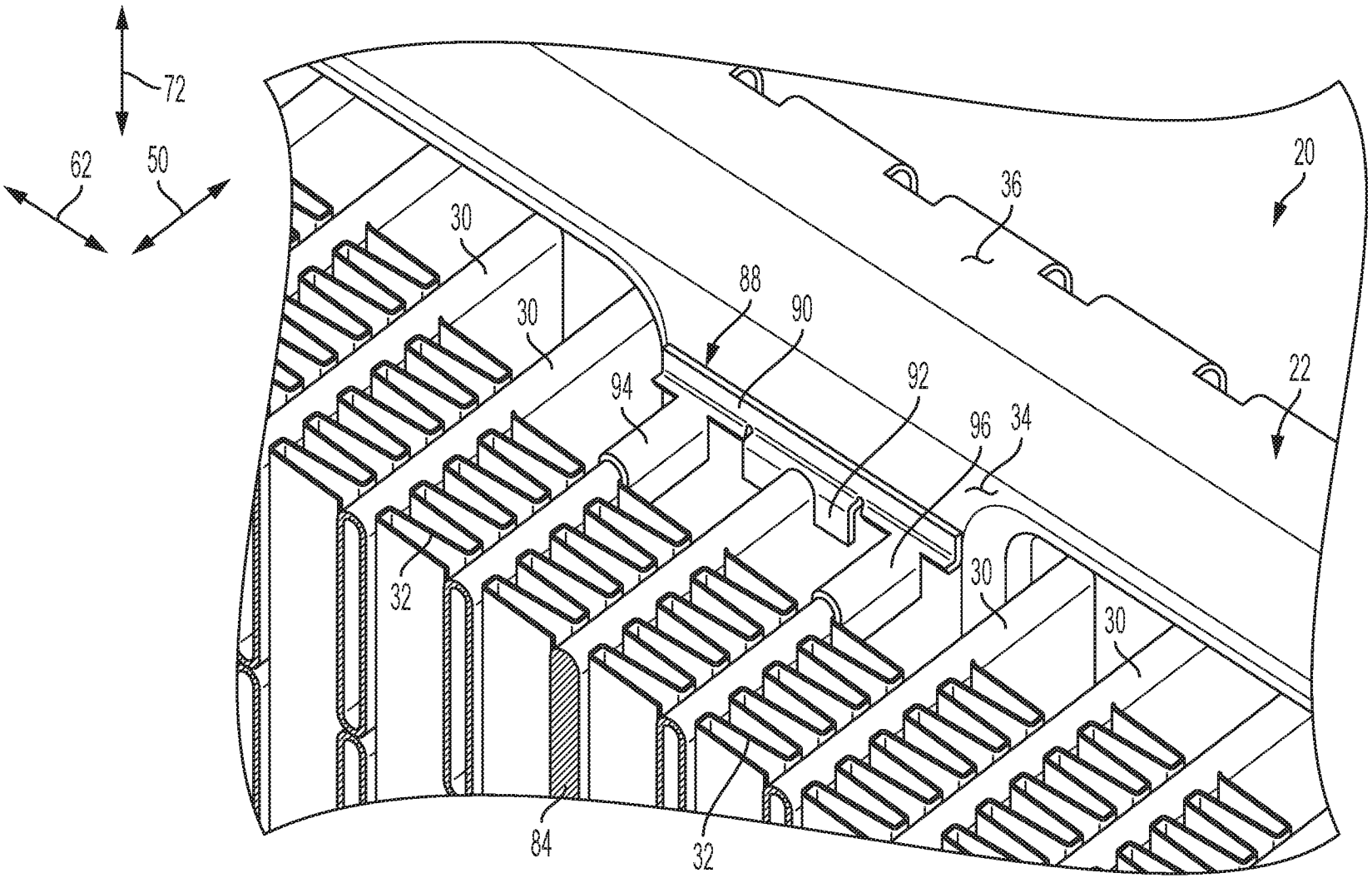
FIG. 8 is a perspective view of a portion of the heat exchanger including the second type of reinforcement member after the second type of reinforcement member has been secured to the heat exchanger.

One of the plurality of tubes 30 in FIGS. 7 and 8 has been exchanged for a "dummy" tube. The dummy tube 84 may be a tube that does not allow fluid to flow from the first header tank 26 to the second header tank 28, unlike the plurality of tubes 30. For example, ends of the dummy tube 84 may be closed off to prevent fluid from flowing from the first header tank 26 to the second header tank 28. Alternatively, the dummy tube 84 may be a solid member as opposed to a hollow member that defines a central opening to channel a fluid. The dummy tube 84 may be a hollow or a solid member while the plurality of tubes 30 are hollow members. A first end of the dummy tube 84 extends into a respective one of the plurality of orifices 28 of the first header 22 while a second end of the dummy tube 84 extends into a respective one of the plurality of orifices 28 of the second header 22 in the same manner as how the plurality tubes 30 extend into the plurality of orifices 28 depicted in FIGS. 1 and 5. The dummy tube 84 may be disposed between first and second tubes of the plurality of tubes 30. The dummy 84 defines a notch 86 that is adjacent to the header 22.

A second type reinforcement member 88 is secured to the header 22. More specifically, the reinforcement member 88 has a backing plate 90 that is secured to the header 22. More specifically, the backing plate 90 may be secured to face plate of the header 22. The backing plate 90 may be secured to the header 22 via brazing, welding, or any other attachment method. The reinforcement member 88 also includes a tab 92 that extends downward from the backing plate 90 and into the notch 86. The engagement between the tab 92 and the notch 86 may to restrict movement of the reinforcement member 88 in the longitudinal direction 50 relative to the plurality of tubes 30 (i.e., the direction in which the plurality of tubes 30 extend). The tab 92 may be secured to the dummy tube 84 within the notch 86 via brazing, welding, or any other attachment method.

The reinforcement member 88 may include a first brace 94 and a second brace 96 that each extend from the backing plate 90. The first brace 94 and second brace 96 may be disposed on opposing sides of the tab 92. The first brace 94 may be secured to a first of the plurality of tubes 30 while the second brace 96 may be secured to a second of the plurality of tubes 30. More specifically, the first brace 94 and second brace 96 may be U-shaped and may straddle a first and a second of the plurality of tubes 30, respectively. The first brace 94 and second brace 96 may be aligned in the transverse direction 62 relative to the plurality of tubes 30 (e.g., a direction that is perpendicular to the longitudinal direction 50). The first brace 94 and second brace 96 may be secured to the first and the second of the plurality of tubes 30, respectively, via brazing, welding, or any other attachment method.

Figure 9:
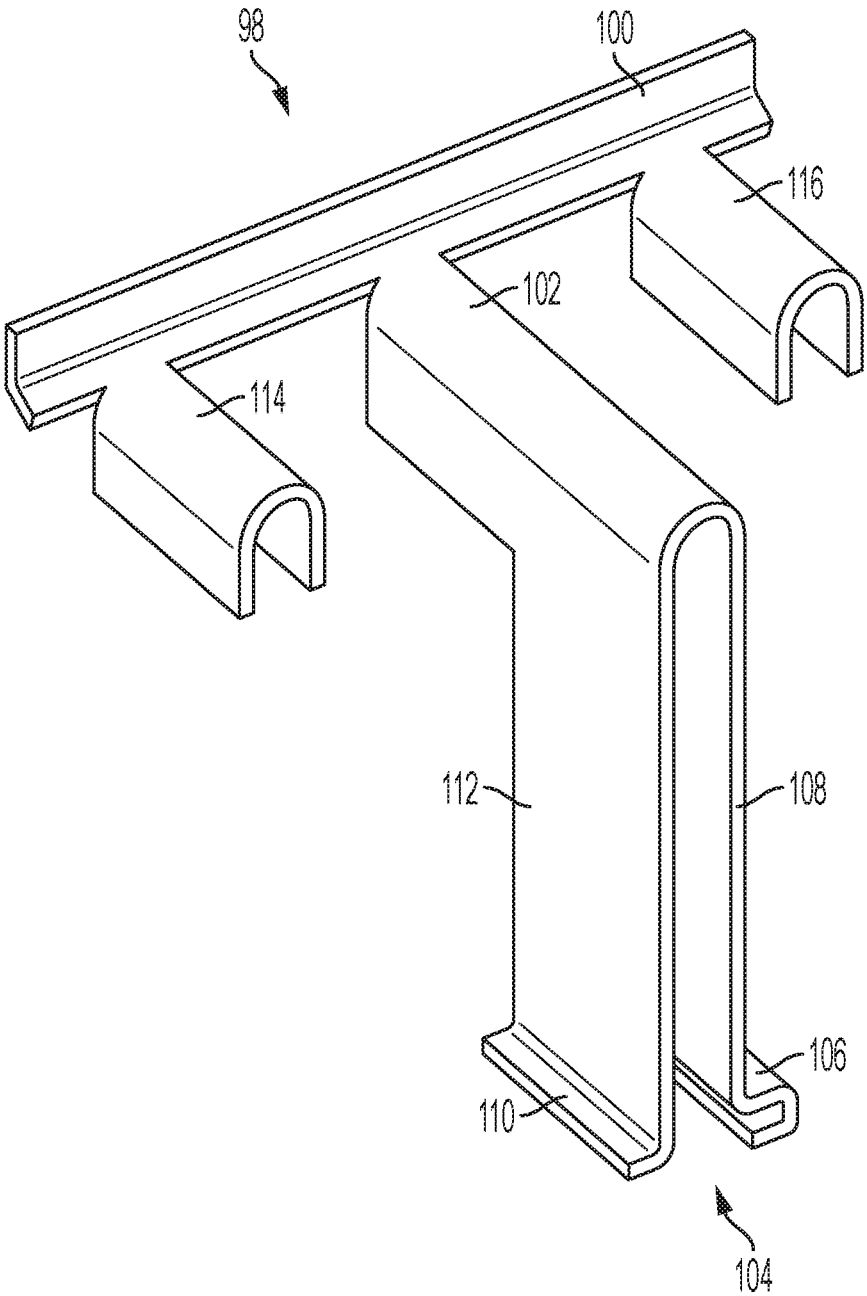
FIG. 9 is a perspective view of a third type of reinforcement member.
Figure 10:
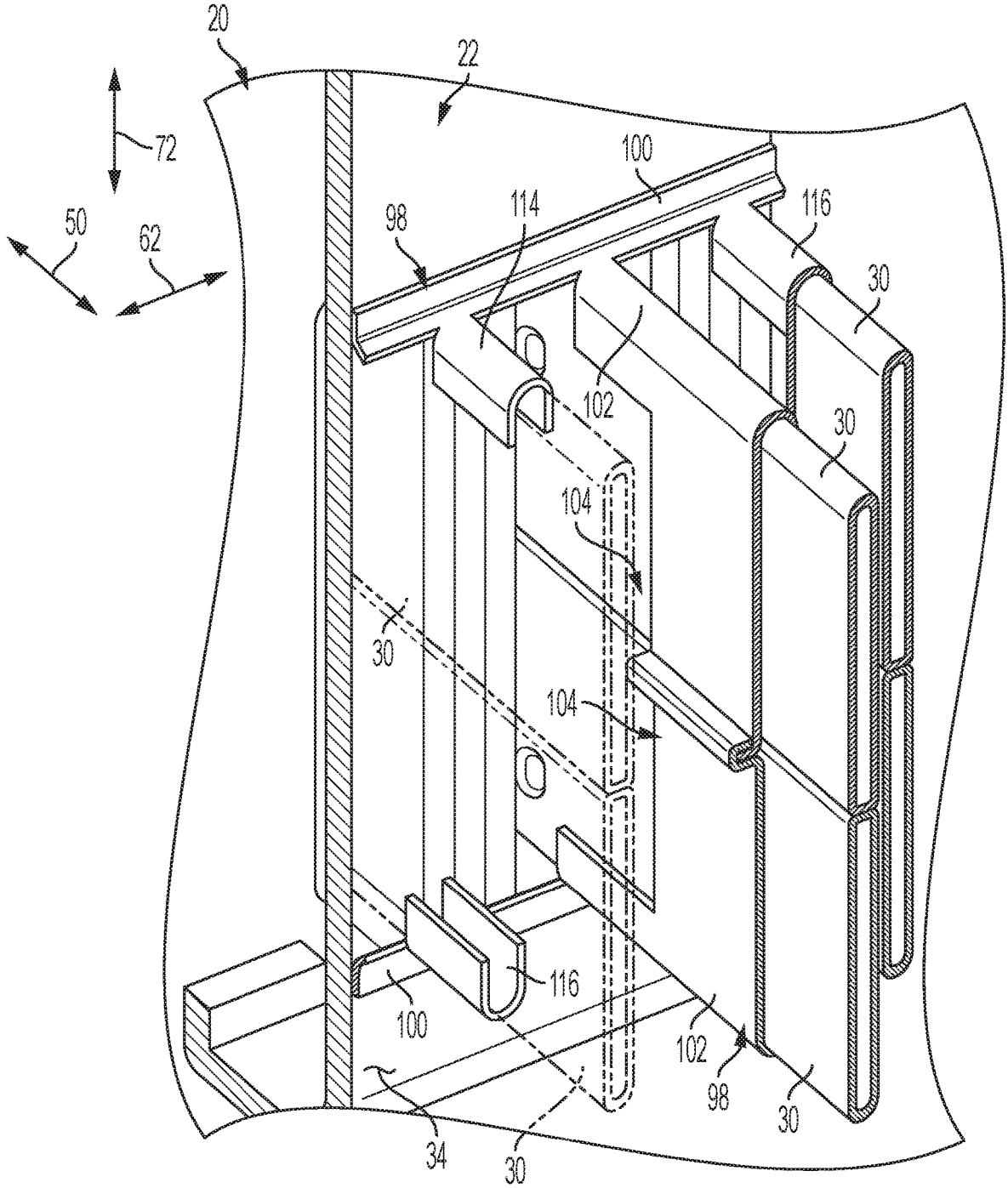
FIG. 10 is a perspective view of a portion of the heat exchanger after a pair of third type of reinforcement members have been secured to the heat exchanger.
Figure 11:
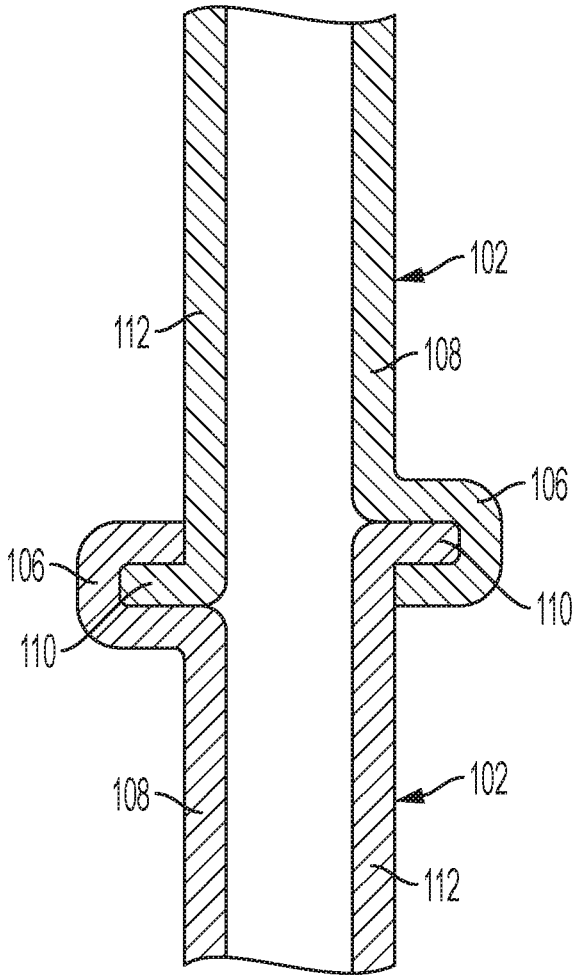
FIG. 11 is a front view of illustrating an interlocking connection between the pair of third type of reinforcement members.

Referring to FIGS. 9, 10, and 11, a perspective view of a third type of reinforcement member, a perspective view of a portion of the heat exchanger 20 after a pair of third type of reinforcement members have been secured to the heat exchanger 20, and a front view of an interlocking connection between the pair of third type of reinforcement members are illustrated, respectively. Please note that some of the tubes 30 are shown in FIG. 10 in phantom lines for illustrative purposes. The heat exchanger 20 depicted in FIGS. 9, 10, and 11 includes all the same components as the heat exchanger depicted in FIGS. 3-5 unless otherwise state herein. For Example, the heat exchanger depicted in FIGS. 9, 10, and 11 may or may not include the projections 38 that overhang the top plate 36 of the header 22.

A pair of the third type of reinforcement members 98 are secured to the heat exchanger 20. The pair of third type of reinforcement members 98 may also be referred to as first and second reinforcement members. The reinforcement members 98 each include a backing plate 100 and a U-shaped bracket 102 extending from the respective backing plate 100. The backing plate 100 of the first of the pair of reinforcement members 98 and the backing plate 100 of the second of the pair of reinforcement members 98 are secured to the header 22 on opposing sides of tubes 30, respectively, in the direction 72 that is perpendicular to the plane that includes the longitudinal direction 50 and the transverse direction 62. The backing plates 100 of the pair of U-shaped brackets 102 may be secured to the header 22 via brazing, welding, or any other attachment method. Open ends 104 of the U-shaped brackets 102 of the pair of reinforcement members 98 extend toward each other from the opposing sides of the tubes 30 (i.e., the open ends 104 extend toward each other in the direction 72 that is perpendicular to the plane that includes the longitudinal direction 50 and the transverse direction 62), straddle at least one of the plurality of tubes 30, and interlock with each other to secure the first to the second of the pair of reinforcement members 98. More specifically, the open ends 104 of the U-shaped brackets 102 of the pair of reinforcement members 98 each include a hook 106 disposed on a first prong 108 of the U-shaped bracket 102 and a protrusion 110 disposed on a second prong 112 of the U-shaped bracket 102. The hook 106 on the open end 104 of the first of the pair of U-shaped brackets 102 engages the protrusion 110 on the open end 104 of the second of the U-shaped brackets 102 while the hook 106 on the open end 104 of the second of the U-shaped brackets 102 engages the protrusion 108 on the open end 104 of the first of the U-shaped brackets 102 to interlock and secure the open ends 104 of the U-shaped brackets 102 of the pair reinforcement members 98 to each other.

The reinforcement members 98 may each include a first brace 114 and a second brace 116 that each extend from the backing plate 100 and are adjacent to the U-shaped bracket 102. The first brace 114 and second brace 116 may be disposed on opposing sides of the U-shaped bracket 102. The first brace 114 may be secured to a first of the plurality of tubes 30 while the second brace 116 may be secured to a second of the plurality of tubes 30. More specifically, the first brace 114 and second brace 116 may be U-shaped and may straddle a first and a second of the plurality of tubes 30, respectively. The first brace 114, second brace 116, and U-shaped bracket 102 may be aligned in the transverse direction 62 relative to the plurality of tubes 30 (e.g., a direction that is perpendicular to the longitudinal direction 50). The U-shaped bracket 102, first brace 114, and second brace 116 of each reinforcement member 98 may be secured to a respective one of the plurality of tubes 30 via brazing, welding, or any other attachment method.

It should be understood that the designations of first, second, third, fourth, etc. for tubes, hollow members, reinforcement members, braces, backing plates, U-shaped brackets, protrusions, projections, orifices, or any other component, state, or condition described herein may be rearranged in the claims so that they are in chronological order with respect to the claims.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A heat exchanger comprising:

a header having a face plate defining a plurality of orifices, a top plate extending away from an end of the face plate, and a projection extending outward from the top plate;

a plurality of tubes, each extending into a respective one of the plurality of orifices; and a reinforcement member having a backing plate that is secured to the top plate, a brace that extends from the backing plate and is secured to a first of the plurality of tubes via welding or brazing, and a protrusion extending outward from the backing plate and engaging the projection to restrict movement of the reinforcement member in a longitudinal direction relative to the tubes.

2. The heat exchanger of claim 1, wherein the brace is U-shaped and straddles the first of the plurality of tubes.

3. The heat exchanger of claim 1, wherein the projection is a hook that overhangs the top plate, and wherein the protrusion is disposed between the hook and the top plate.

4. The heat exchanger of claim 1, wherein the reinforcement member further comprises a second brace that extends from the backing plate and is secured to a second of the plurality of tubes.

5. The heat exchanger of claim 4, wherein the second brace is offset from the first brace.

6. The heat exchanger of claim 1, further comprising a second reinforcement member having a second backing plate that is secured to the top plate and a second brace that extends from the second backing plate and is secured to a second of the plurality of tubes.

7. The heat exchanger of claim 6, wherein the header has a second projection extending outward from the top plate and the second reinforcement member has a second outwardly extending protrusion, and wherein the second outwardly extending protrusion engages the second projection to restrict movement of the second reinforcement member in the longitudinal direction relative to the tubes.

8. The heat exchanger of claim 6, wherein the second reinforcement member has a third brace that extends from the second backing plate and is secured to a third of the plurality of tubes.

9. The heat exchanger of claim 6, further comprising a third reinforcement member having a third backing plate that is secured to the top plate and a third brace that extends from the third backing plate and is secured to a third of the plurality of tubes.

10. The heat exchanger of claim 9, wherein the header has a third projection extending outward from the top plate and the third reinforcement member has a third outwardly extending protrusion, and wherein the third outwardly extending protrusion engages the third projection to restrict movement of the third reinforcement member in the longitudinal direction relative to the tubes.

11. The heat exchanger of claim 9, wherein the third reinforcement member has a fourth brace that extends from the third backing plate and is secured to a fourth of the plurality of tubes.

* * * * *